US012091614B2

(12) United States Patent
Wu et al.

(10) Patent No.: US 12,091,614 B2
(45) Date of Patent: Sep. 17, 2024

(54) SOLIDS FLOCCULATION/AGGLOMERATION IN SOLVENT EXTRACTION OF BITUMEN FROM OIL SAND

(71) Applicant: SYNCRUDE CANADA LTD. IN TRUST FOR THE OWNERS OF THE SYNCRUDE PROJECT AS SUCH OWNERS EXIST NOW AND IN THE FUTURE, Calgary (CA)

(72) Inventors: Xin Alex Wu, Edmonton (CA); Sujit Bhattacharya, Edmonton (CA)

(73) Assignee: SYNCRUDE CANADA LTD. IN TRUST FOR THE OWNERS OF THE SYNCRUDE PROJECT AS SUCH OWNERS EXIST NOW AND IN THE FUTURE, Calgary (CA)

( * ) Notice: Subject to any disclaimer, the term of this patent is extended or adjusted under 35 U.S.C. 154(b) by 0 days.

(21) Appl. No.: 17/881,959

(22) Filed: Aug. 5, 2022

(65) Prior Publication Data

US 2023/0064820 A1 Mar. 2, 2023

Related U.S. Application Data

(60) Provisional application No. 63/234,572, filed on Aug. 18, 2021.

(51) Int. Cl.
*C10G 1/04* (2006.01)

(52) U.S. Cl.
CPC ..... *C10G 1/045* (2013.01)

(58) Field of Classification Search
CPC ..... C10G 1/04–045
See application file for complete search history.

(56) References Cited

U.S. PATENT DOCUMENTS

| | | | | |
|---|---|---|---|---|
| 4,311,561 | A * | 1/1982 | Hastings | B01D 11/028 422/283 |
| 4,719,008 | A | 1/1988 | Sparks et al. | |
| 2014/0262964 | A1* | 9/2014 | Han | C10G 1/045 208/390 |
| 2019/0153326 | A1* | 5/2019 | Wu | B01F 35/531 |

FOREIGN PATENT DOCUMENTS

| | | |
|---|---|---|
| CA | 2751719 | 3/2012 |
| CA | 2740468 | 11/2012 |
| CA | 2740670 | 11/2012 |
| CA | 2895118 | 12/2016 |
| CA | 2986395 | 5/2019 |
| CA | 3093099 | 3/2021 |

OTHER PUBLICATIONS

Parr Instrument Company Stirred Reactors and Pressure Vessels, Bulletin 4500, vol. 15; obtained from <https://www.equilabo.com/images/PDF/4500MB-Parr-Stirred-Reactors-and-Pressure-Vessels-Catalog-v15-Literature-2.pdf> (Year: NA).*

* cited by examiner

*Primary Examiner* — Renee Robinson
(74) *Attorney, Agent, or Firm* — Knobbe, Martens, Olson & Bear, LLP

(57) ABSTRACT

A process and apparatus is provided for flocculating and/or agglomerating oil sand solids during solvent extraction, the process using a mixing tank comprising a vertical baffle-free cylindrical vessel having at least one impeller mounted vertically therein.

30 Claims, 6 Drawing Sheets

SOLIDS FLOCCULATION/AGGLOMERATION IN SOLVENT EXTRACTION OF BITUMEN FROM OIL SAND

TECHNICAL FIELD

The following relates generally to solvent extraction of bitumen from mined oil sand. In particular, an apparatus and process is provided for flocculating and/or agglomerating oil sand solids during solvent extraction.

BACKGROUND

The present commercial bitumen extraction process for mined oil sands is Clark hot water extraction technology, or its variants, that uses large amounts of water and generates a great quantity of wet tailings. Part of the wet tailings becomes fluid fine tailings (FFT), which, when settling in tailings containment structures for several years, ultimately reach approximately 30% fine solids (often referred to as mature fine tailings or MFT) and are a great challenge for the industry to reclaim. In addition, certain "problem" oil sands, often those having high fines content, yield low bitumen recoveries in the water-based extraction process. This leads to economic losses and environmental issues with bitumen in wet tailings.

An alternative to water-based extraction is solvent extraction of bitumen from mined oil sands, also referred to as non-aqueous extraction or NAE, which uses little or no water, generates no wet tailings, and can potentially achieve higher bitumen recovery than the existing water-based extraction, especially for the aforementioned problem oil sands. Therefore, solvent extraction is potentially more robust and more environmentally friendly than water-based extraction.

One key challenge of solvent extraction processes is the promotion of flocculation/agglomeration of the oil sand solids, which is generally achieved with the addition of a bridging liquid (e.g., water), without harmful solids buildup or deposition and at a reasonable energy input. As used herein, "flocculation" refers to a process for making oil sand solid aggregates of smaller than 1 mm in size and "agglomeration" refers to a process to make oil sand solid aggregates of larger than 1 mm in size. It was discovered by the present applicant that solids buildup or deposition in a mixing tank during flocculation/agglomeration can be minimized by using a heavy solvent with higher density and viscosity, such as light gas oil, in a dual-solvent extraction (DSE) process, as described in Canadian Patent Nos. 2,751,719 and 2,895,118. However, when a single light solvent, such as light naphtha, is used, as described in Canadian Patent Application No. 3,093,099, which significantly saves capital cost as compared to DSE, the solids buildup problem becomes more pronounced. Furthermore, an energy input of about 10 W/kg of slurry or higher is required with the mixing tank configurations as disclosed in Canadian Patent Nos. 2,895,118 and 2,986,395. For a 2400 t/h commercial plant with a 5 minute residence time in a mixing tank, the energy input needs to be about 3.2 MW. This high energy demand requires multiple tanks, mixing motors, slurry distributors and slurry pumps, which increase the cost.

Many apparatuses can make either type of oil sand solid aggregates, depending on conditions such as water dosage and residence time. Various apparatuses were proposed in the literature for oil sand solids flocculation/agglomeration in hydrocarbons. In one process, as described in U.S. Pat. No. 4,719,008, an "agglomerator" resembling a horizontal tumbler with rods inside, is used. This apparatus does not cause solids deposition but its agglomeration action is typically inefficient. In another process, as described in Canadian Patent No. 2,740,468, apparatuses including all forms of agitation, e.g. mixing tanks, blenders, attrition scrubbers and tumblers were proposed. However, no specifics were given as to the design of these mixing vessels except that the mixing vessels must have a sufficient amount of agitation to keep the formed agglomerates in suspension. In another process, as described in Canadian Patent No. 2,740,670, a pipeline is used to agglomerate solids, which may be less likely to cause solids deposition than a mixing tank if a flow of certain velocity is kept. However, a long slurry pipeline is susceptible to leakage generating a fire hazard when the slurry contains flammable solvents.

In a DSE process, as described in Canadian Patent Nos. 2,986,395 and 2,895,118, a baffled mixing tank and one or multiple vertically mounted impellers are used. The baffles are of the conventional type: vertical strips from the top to the bottom of a mixing tank. Baffles help lift up solids during mixing and are generally considered essential for proper mixing and flocculation/agglomeration. The impellers are oversized with a diameter of 0.55-0.7 of the tank diameter to minimize solids buildup inside the tank. However, this design is not sufficient to prevent buildup problem when a single light solvent is used.

Hence, improper mixing vessel geometry and conditions may cause solids buildup and deposition regardless of agitation energy input. Thus, there is a need in the industry for a mixing device or mixing tank that will provide proper mixing for flocculation/agglomeration of oil sand solids to occur during solvent extraction, even when using a single light solvent for extraction, and which uses less energy than some of the prior art mixing devices.

SUMMARY

The present application relates generally to solvent extraction of bitumen from mined oil sand and, more particularly, to an apparatus and process for flocculating and agglomerating oil sand solids during solvent extraction of bitumen from mined oil sand ore. The present apparatus and process can be used with a variety of solvent extraction processes, for example, dual solvent extraction and single solvent extraction, and is particularly effective for single solvent extraction using a light single solvent such as naphtha.

In one aspect, a process is provided for flocculating and agglomerating oil sand solids during solvent extraction of bitumen from oil sand ore, comprising:

- treating the oil sand ore with at least one solvent to produce an oil sand and solvent slurry;
- feeding the oil sand and the at least one solvent slurry into a mixing tank and adding a bridging liquid to the mixing tank to flocculate or aggregate solids present in the oil sand and at least one solvent slurry to produce a flocculated/aggregated slurry; and
- removing the flocculated/aggregated slurry from the mixing tank and subjecting the flocculated/aggregated slurry to a separation step to separate liquid from solids;
- whereby the mixing tank comprises a vertical baffle-free cylindrical vessel having at least one impeller mounted vertically therein.

In one embodiment, the at least one solvent comprises a heavy solvent (HS). In one embodiment, the solvent comprises two different solvents, a heavy solvent (HS) and a light solvent (LS). In one embodiment, the at least one solvent comprises a light solvent (LS). In one embodiment, the oil sand ore is pre-crushed oil sand ore.

In one embodiment, the at least one impeller has a diameter of about 0.5 to 0.8 times that of the cylindrical vessel diameter. In one embodiment, the impeller comprises a plurality of blades or vanes. In one embodiment, the blades are down-pumping blades or up-pumping blades or both. In one embodiment, the impeller comprises a pitched blade turbine (PBT) mixing impeller or a flat blade turbine mixing impeller.

In one embodiment, the oil sand and at least one solvent slurry is added to the mixing tank so that a height of the oil sand and at least one solvent slurry is about 0.2 to 0.8 times the cylindrical vessel diameter. In one embodiment, the vertically mounted impeller is mounted at a height of about 0.01 to about 0.1 times the cylindrical vessel diameter from the bottom of the cylindrical vessel.

In another aspect, a mixing tank useful for flocculating or aggregating oil sand solids present in an oil sand and solvent slurry is provided, comprising:

- a cylindrical vessel having a closed top having a lid, a closed bottom and a vessel diameter; and
- at least one essentially vertical impeller having a diameter of about 0.5 to about 0.8 times the vessel diameter for mixing the oil sand and solvent slurry and flocculating or aggregating the oil sand solids therein;
- whereby the cylindrical vessel has a smooth wall and does not have any vertical baffles.

In one embodiment, the mixing tank further comprises at least one horizontal tube or plate situated above the vertical impeller, the at least one horizontal tube or plate adapted to provide heat to the mixing tank.

BRIEF DESCRIPTION OF THE DRAWINGS

The process and apparatus will now be described by way of an exemplary embodiment with reference to the accompanying simplified, diagrammatic, not-to-scale drawings.

DETAILED DESCRIPTION

The detailed description set forth below in connection with the appended drawings is intended as a description of various embodiments and is not intended to represent the only embodiments contemplated by the inventors. The detailed description includes specific details for the purpose of providing a comprehensive understanding of the process and apparatus herein.

A solvent extraction process is provided and, more particularly, a mixing tank useful in flocculating/agglomerating solids present in oil sand/solvent slurries during solvent extraction of bitumen from oil sand ore is provided.

As previously mentioned, one key challenge of solvent extraction processes for extracting bitumen from oil sand is the removal of the oil sand solids from an oil sand/solvent slurry. Thus, presented herein is a process and apparatus for flocculating and/or agglomerating oil sand solids present in an oil sand/solvent slurry.

As previously mentioned, "flocculation" refers to a process for making oil sand solid aggregates of smaller than 1 mm in size and "agglomeration" refers to a process to make oil sand solid aggregates of larger than 1 mm in size.

As used herein, "heavy solvent (HS)" means a light gas oil stream, for example, a distillation fraction of oil sand bitumen, comprising a mixture of $C_9$ to $C_{32}$ hydrocarbons with a boiling range within about 130° C. to about 470° C. The light end boiling below about 170° C. should be less than 5 wt %. It has a flash point of about 90° C. in air.

As used herein, "light solvent (LS)" means a hydrocarbon stream comprising $C_6$-$C_{10}$ hydrocarbons with a boiling range of 60-170° C. The preferred LS is aliphatic $C_6$-$C_7$ with a boiling range of 69-110° C. It has a flash point below 0° C. in air.

Figure 1:
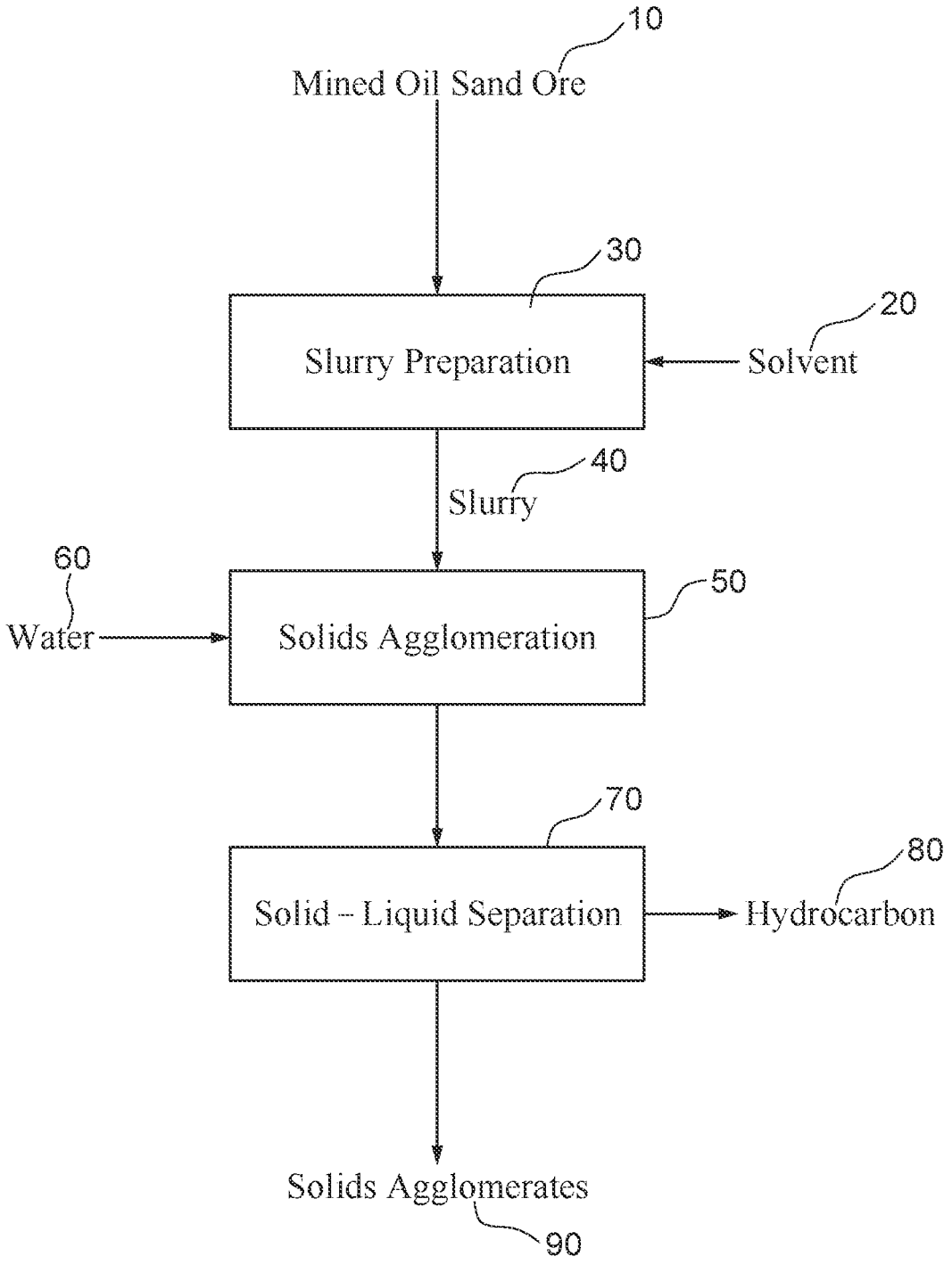
FIG. 1 is a schematic process flow diagram of one embodiment of a solvent extraction process.

With reference now to FIG. 1, an embodiment of the steps of a solvent extraction process for oil sands are illustrated. As mined oil sand ore 10 is mixed with hot solvent 20 in a slurry preparation and conditioning unit 30 to form a solvent/oil sand slurry. The oil sand ore 10 may have been crushed in a two-stage sizer/crusher. The hot solvent stream 20 may contain recycled bitumen from the downstream units, e.g. stream 80. The unit 30 may comprise a rotating tumbler. Longitudinal lifters may be present in the tumbler to assist in the further comminution of large oil sand lumps by lifting and dropping them on other oil sand lumps. The solids content in the solvent/oil sand slurry is about 60-75 wt % and the bitumen concentration is generally about 50 wt %. The slurry temperature is preferably around 50° C. In one embodiment, the source of heat comes primarily from the hot solvent stream 20. In one embodiment, the solvent used is a HS. In another embodiment, the solvent used is a LS. In yet another embodiment, the solvent used is a mixture of HS and LS.

The slurry stream 40 is then subjected to a solids flocculation/agglomeration step 50, where water is added to the slurry to aggregate the fines with sand grains. This minimizes the fines liberation into the hydrocarbon phase. The aggregation of fines with sand grains forms aggregates of near 0.3 mm or larger which are characterized as having a funicular structure with a greater amount of water molecules filling the spaces among the solids, and more securely bridging the solids together. The percentage of pore filling by the bridging water ranges from about 45% to about 95%. The size of aggregates mostly depends on water dosage and mixing time. As used herein, "flocs" and "agglomerates" refer to particles of different sizes, namely, smaller than 1 mm in size and larger than 1 mm in size, respectively, while "aggregate" is a general term for either flocs or agglomerates.

The solids flocculation/agglomeration step 50 uses a mixing tank 150, which will be described in more detail below. After solids flocculation and/or agglomeration has occurred, the flocculated/agglomerated slurry is then subjected to the step of solid-liquid separation 70, such as filtration, to provide solid aggregates 90 and a hydrocarbon product 80 having substantially reduced solids therein.

Figure 2:
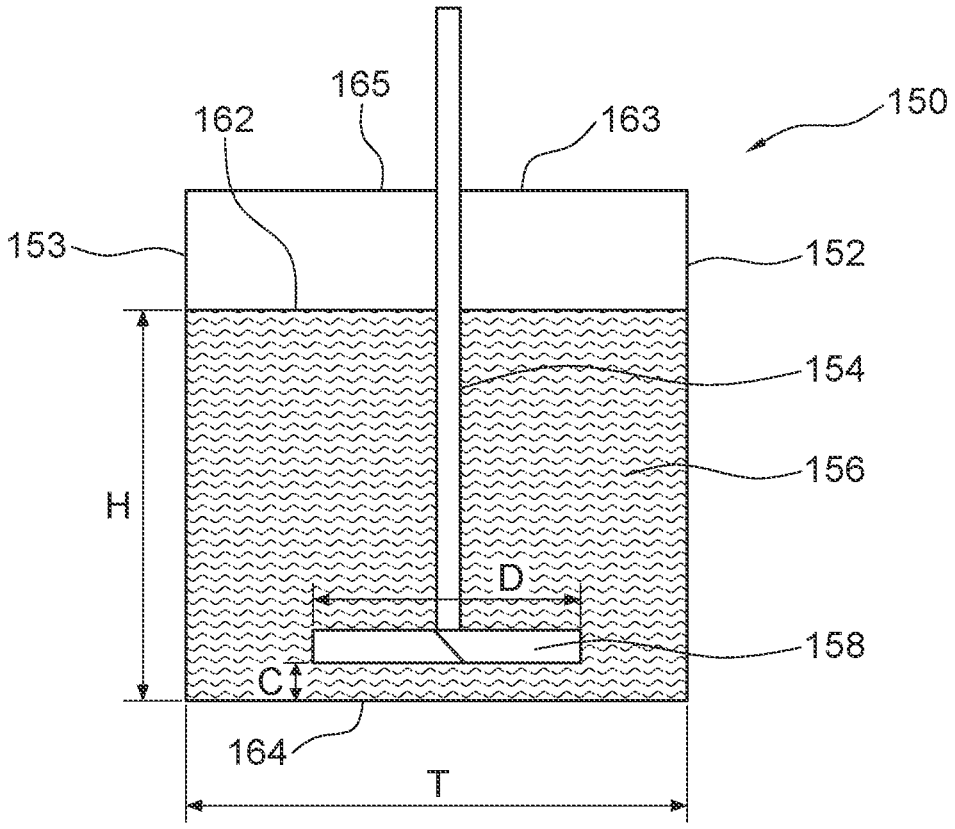
FIG. 2 is a schematic diagram of one embodiment of a mixing tank useful in a solvent extraction process.

One embodiment, mixing tank 150, is shown in FIG. 2. Mixing tank 150 comprises a cylindrical vessel 152 having a vessel diameter (T) and at least one essentially vertical impeller 154 having a diameter (D) of about 0.5 to about 0.8 times the vessel diameter (D/T), which is driven by a drive motor (not shown), for mixing the oil sand and solvent slurry and flocculating or aggregating the oil sand solids therein. Cylindrical vessel 152 has smooth walls 153. The bottom clearance (C) of the vertical impeller 154 is about 0.01-0.1 of the tank diameter (T) (C/T). The slurry 156 height (H) is 0.2-0.8 of the tank diameter (T). The impeller comprises 45° pitched-blade turbines 158. It is understood, however, flat blade turbine, down-pumping pitch-blade turbines or up-pumping pitch blade turbines or other design of impellers known in the art can also be used. It is further understood that the mixing tank may comprise more than one impeller. In the embodiment shown in FIG. 2, the closed bottom 164 of mixing tank 150 is flat but it is understood that the bottom of a mixing tank useful in the solvent extraction process can also be dished. In one embodiment, the slurry discharge is at the bottom 164 of the tank. In another embodiment, the slurry discharge is at the top of the slurry layer 162 in the tank. The top 163 is closed with lid 165.

It can further be seen from FIG. 2, that mixing tank 150 is free from any vertical baffles. It was surprisingly discovered by the present applicant that the power input of impeller 154 necessary to bring about near optimal flocculation/agglomeration of the solids present in the oil sand/solvent slurry was about half of that in a mixing tank with the identical configuration but with standard vertical baffles. It is understood that using mixing tanks with lower energy requirements will greatly reduce the cost of running a commercial plant.

Vertical baffles are generally included in mixing tanks to promote the upward movement of the slurry. Such baffles are usually considered essential for proper mixing. However, a significant amount of energy is necessary for this solids uplifting motion. It was surprising, however, to discover that the flocculation/agglomeration of oil sand solids in oil sand/solvent slurries does not require the drastic upward movement aided by vertical baffles. Small vertical movement of the slurry driven by the 45° PBT and the rise and fall of the slurry along the tank wall was discovered to be able to generate sufficient up and down mixing action and shear to enable solids flocculation/agglomeration. Removal of the baffles brings in significant energy savings. Most importantly, without vertical baffles, slurry moves at a higher tangential velocity everywhere in the mixing tank that minimizes harmful solids buildup or deposition when processing oil sand.

Figure 3:
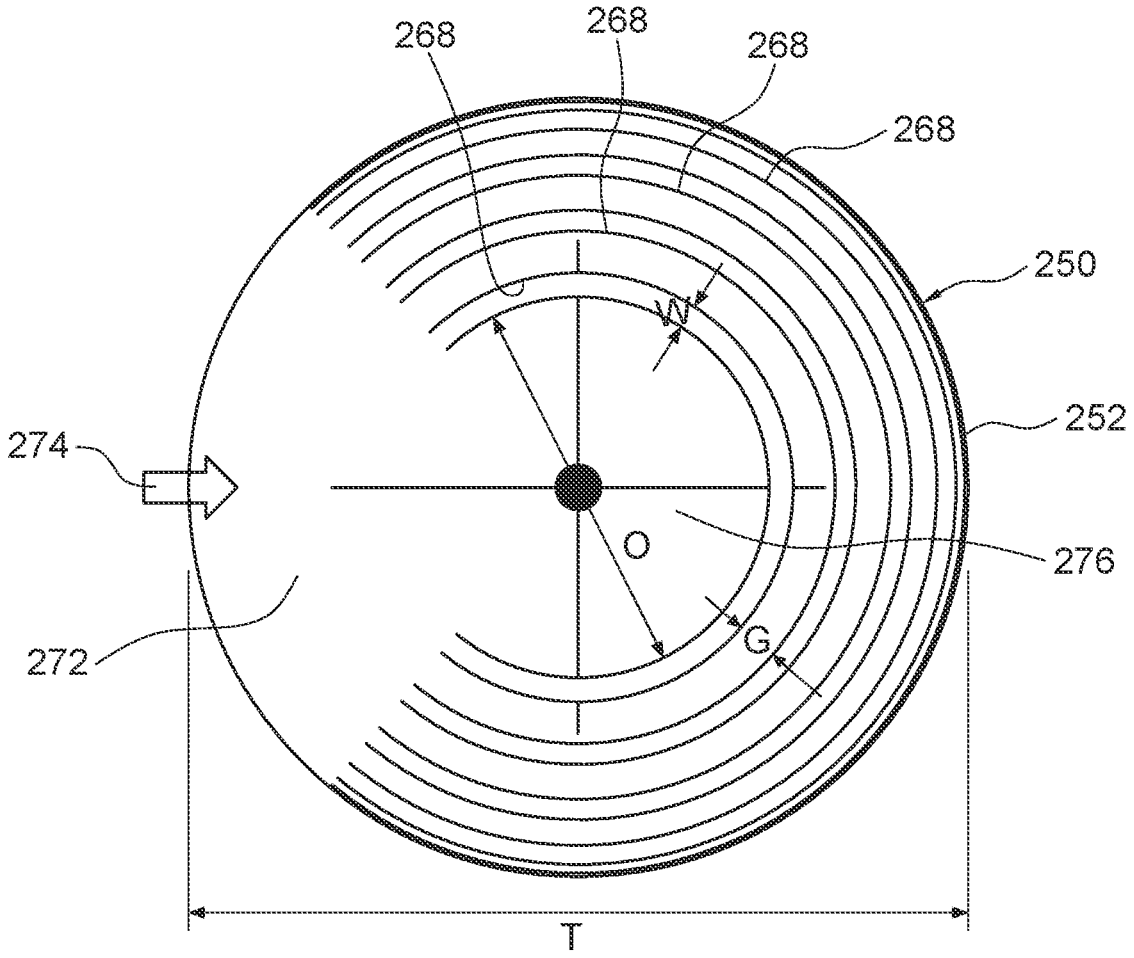
FIG. 3 is a schematic diagram of the top view of another embodiment of a mixing tank useful in a solvent extraction process.

With reference now to FIG. 3, in another embodiment, the mixing tank 250 further comprises at least one partially circumferential horizontal plate or tube 268 placed near the slurry surface, especially near the circumference of the tank, to minimize rise of the slurry along the tank wall and reduce the size of a central vortex. A large vortex causes slurry aeration and reduces mixing energy input. In one embodiment, the at least one plate or tube 268 further provides a heat-exchanging surface to provide heat to the slurry. In FIG. 3, it can be seen that there are four such horizontal plates or tubes 268 provided. As can further be seen in FIG. 3, these partially circumferential plates or tubes 268 only cover approximately ¾ of the total circumference of the cylindrical vessel 252. The other ¼ of the total circumference of the cylindrical vessel acts as a feeding area 272 for feeding the oil sand/solvent slurry 274 into the mixing tank 250. It is understood, however, that the feeding area 272/total cross-section area can range between about 0.1 to about 0.3.

In the embodiment shown in FIG. 3, if tubes are used, the tubes generally have a diameter (W/T) of about 0.001 to about 0.1. When plates are used, the plates have a width (W/T) of about 0.001 to about 0.1 and a thickness (X/W) of about 0.1 to about 0.5. The thickness X is not shown in FIG. 3. The gap width (G/T) between each plate or tube ranges from 0 to about 0.1. The central hole diameter (O/T) ranges from about 0.1 to about 0.5.

Figure 4:
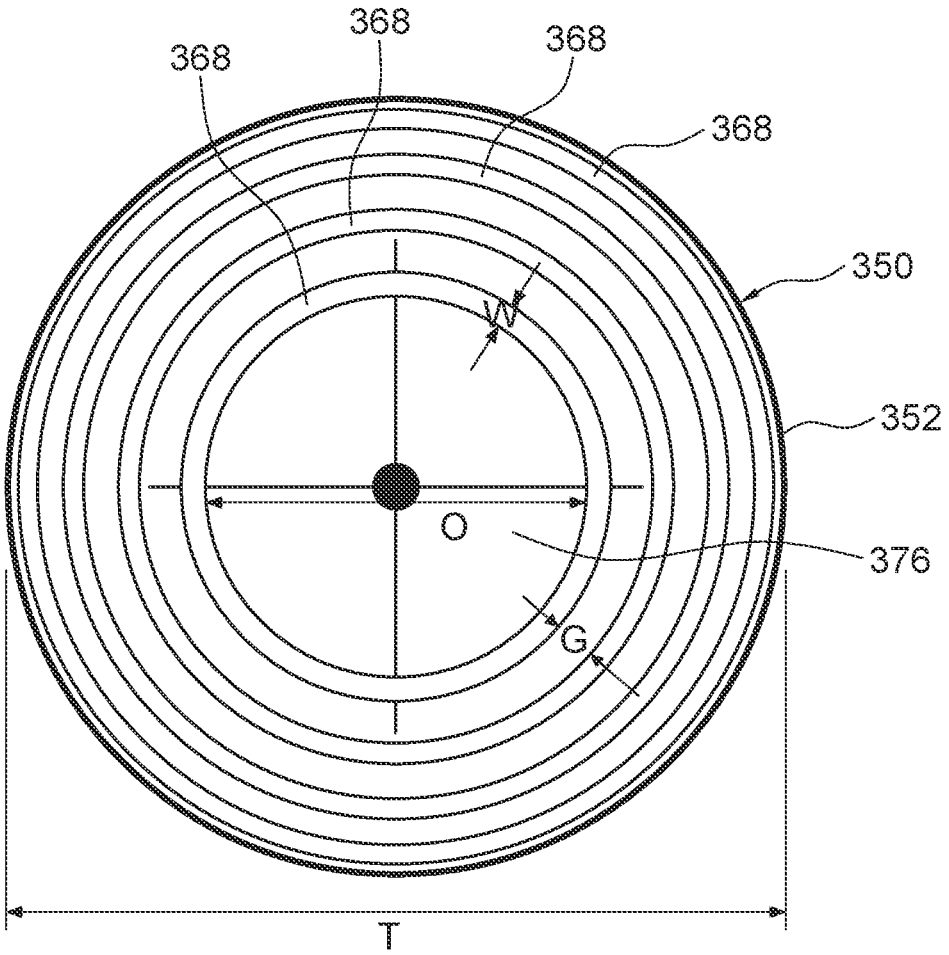
FIG. 4 is a schematic diagram of the top view of another embodiment of a mixing tank useful in a solvent extraction process.

With reference now to FIG. 4, in another embodiment, the mixing tank 350 further comprises at least one completely circumferential horizontal plate or tube 368 placed near the slurry surface, above the impeller(s), and especially near the circumference of the tank, to minimize rise of the slurry along the tank wall and development of a central vortex. In one embodiment, the at least one plate or tube 368 further provides a heat-exchanging surface to provide heat to the slurry. In FIG. 4, it can be seen that there are four such completely circumferential horizontal plates or tubes 368 provided.

In the embodiment shown in FIG. 4, if tubes are used, the tubes generally have a diameter (W/T) of about 0.001 to about 0.1. When plates are used, the plates have a width (W/T) of about 0.001 to about 0.1 and a thickness (X/W) of about 0.1 to about 0.5. The thickness X is not shown in FIG. 4. The gap width (G/T) between each plate or tube ranges from 0 to about 0.1. The central hole diameter (O/T) ranges from about 0.1 to about 0.5.

In one embodiment, horizontal plates or tubes of FIGS. 3 and 4 are placed near the slurry surface, especially near the circumference of the mixing tank to provide heat to the slurry. Further, having the horizontal plates or tubes near the slurry surface, especially near the circumference of the tank, minimizes the rise of the slurry along the tank wall and reduces the size of the central vortex.

Figure 5:
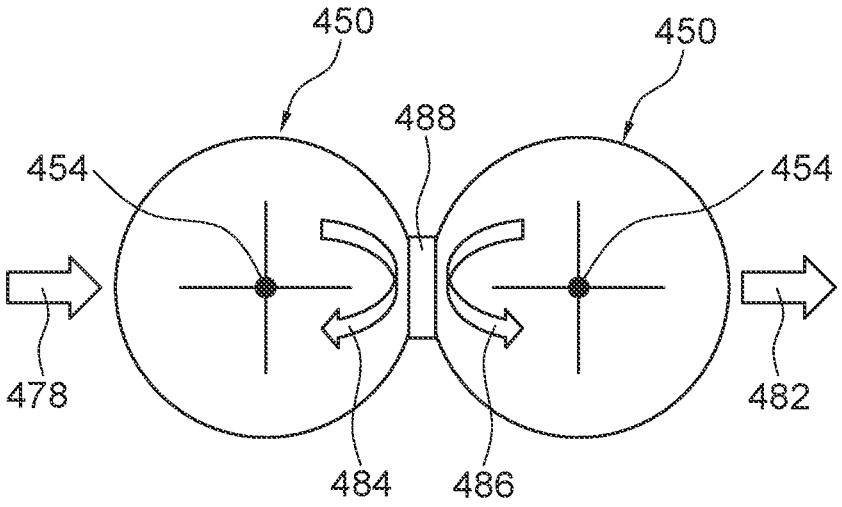
FIG. 5 is a schematic diagram of two mixing tanks of FIG. 1 arranged in series in a single train.

With reference now to FIG. 5, FIG. 5 shows two mixing tanks 450 of any of the mixing tank embodiments discussed above connected in series. Each mixing tank 450 has its own impeller 454 and drive motor (not shown). The two tanks are connected through a large opening on the bottom parts of their walls via connector 488. The size of the opening on the bottom parts of their walls is about 0.2 to about 1 of the tank diameter. The opening may be of a square or a round shape. Because of higher tangential velocity of slurry in baffle-free tanks, slurry readily exchanges from one tank to another through the opening. It saves slurry transfer pumps and level controls when multiple tanks must be used in large-scale operations. The oil sand/solvent slurry 478 is fed into the left tank and slurry discharge 482 is discharged from the right tank. Arrow 484 shows that the left mixing tank is operating clockwise and the arrow 486 shows that the right mixing tank is operating counter clockwise. In one embodiment, the impeller rotational directions in any tanks are different. In one embodiment, the left tank in FIG. 5 contains horizontal plates or tubes as shown in FIG. 3, and the right tank in FIG. 5 contains horizontal plates or tubes as shown in FIG. 4.

Figure 6:
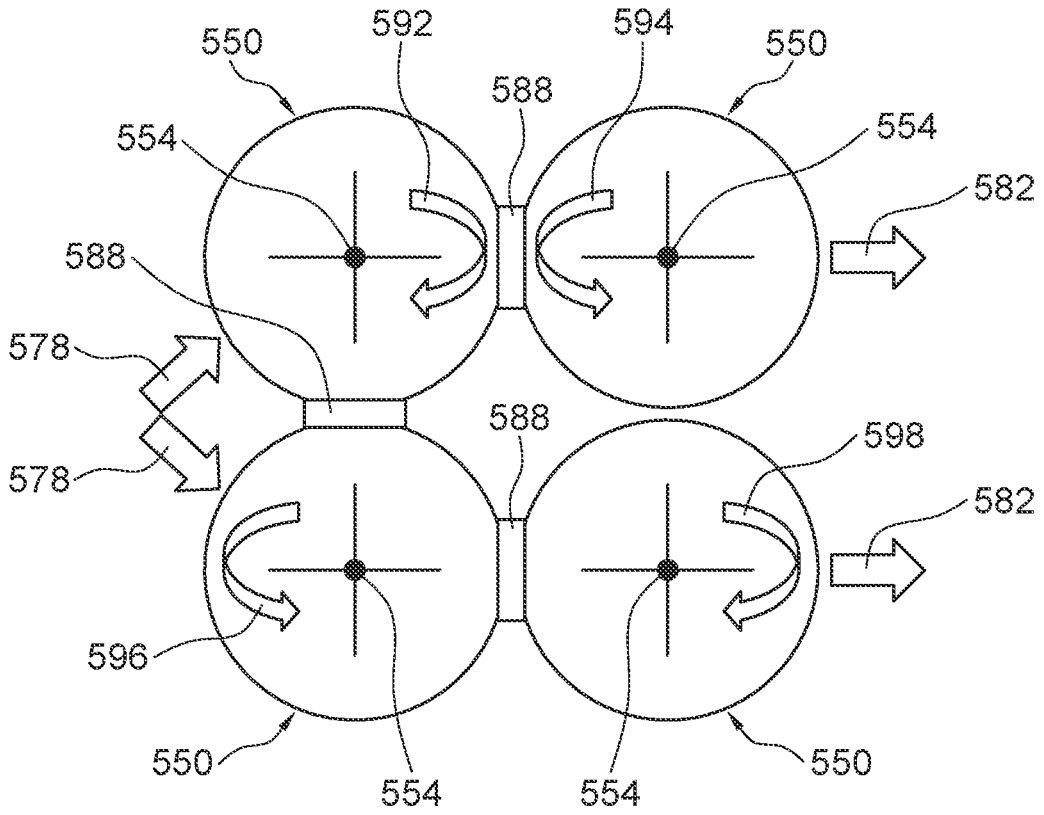
FIG. 6 is a schematic diagram of four mixing tanks of FIG. 1 arranged in a series of two parallel trains.

With reference now to FIG. 6, FIG. 6 shows four mixing tanks 550 of any of the mixing tank embodiments discussed above whereby the top left and the bottom left mixing tanks are connected in parallel via connector 588. The left and right mixing tanks on top and on bottom are both connected in series via connector 588. Each mixing tank 550 has its own impeller 554 and drive motor (not shown). The tanks 550 are connected through large openings on the bottom parts of their respective walls. The size of the opening is 0.2-1 of the mixing tank diameter. The opening may be of a square or a round shape. Because of higher tangential velocity of slurry in baffle-free tanks, slurry readily exchanges from one tank to another through the opening. It saves slurry transfer pumps and level controls when multiple tanks must be used in large-scale operations. The slurry 578 is fed into the two tanks on the left and slurry discharge 582 is discharged from the two tanks on the right. With respect to the top two mixing tanks, arrow 592 shows that the left mixing tank is operating clockwise and the arrow 594 shows that the right mixing tank is operating counter clockwise. Similarly, with respect to the bottom two mixing tanks, arrow 596 shows that the left mixing tank is operating counter clockwise and the arrow 598 shows that the right mixing tank is operating clockwise. In one embodiment, the impeller rotational directions in any tanks are different. In one embodiment, the left two tanks in FIG. 6 contain horizontal plates or tubes as shown in FIG. 3, and the right two tanks in FIG. 6 contain horizontal plates or tubes as shown in FIG. 4.

Example 1

In the following example, the oil sand used contained 10.3 wt % bitumen, 3.6 wt % water and 86.1 wt % solids. The fines (<44 μm) content in the solids was 17 wt %. 750 g of this oil sand was used with 22.5 g added water and a bitumen-in-light naphtha solution containing 18 wt % bitumen and 82 wt % light naphtha in each test. As used herein, "light naphtha" is a hydrocarbon solvent comprising mainly aliphatic $C_6$-$C_9$ hydrocarbons with a boiling range of about 60° C. to about 160° C. The added water came from an oil sand tailings pond with pH 8.5. The hydrocarbon phase in the slurry prior to the first filtration step comprised about 33 wt % bitumen and 67 wt % light naphtha. The solids content in the slurry was about 53 wt %.

The solids were flocculated in a batch mixing tank of 13 cm in diameter (T) at about 50° C. The impeller was a 6-blade 45° PBT of 7.6 cm in diameter (D). The bottom clearance (C) was about 0.3 cm. The approximate slurry height was 6 cm. The impeller was turned to pump down at 1100 rpm for 5.5 min. In test #1, four standard vertical baffles were inserted into the mixing tank. In test #2, no baffles were used. Other parameters were identical. The mixed slurry was transferred to a top-loading batch filter with about −16.7 kPa g pressure in its filtrate receiver. The cake thickness was about 5 cm. After $1^{st}$-stage drainage, 225 g of light naphtha was added to the filter cake for washing and $2^{nd}$-stage drainage. Both drainage stages were timed. 5 and 10 s drying time was allowed after $1^{st}$- and $2^{nd}$-stage drainage, respectively. Vacuum and filtrate flow were turned off after drying time. The total amount of time under vacuum was used to calculate the filter process rate. The cake was then analyzed for its bitumen content, which was used to calculate the bitumen recovery. The results are shown in Table 1, below.

TABLE 1

Results of solids flocculation tests #1 and #2

| Test No. | Baffle Number | Filter Process Rate ($t/m^2h$) | Water-to-Solids Mass Ratio | Bitumen Recovery (%) | Energy Input (W/kg) |
|---|---|---|---|---|---|
| #1 | 4 | 12.7 | 0.061 | 93.8 | 12.1 |
| #2 | 0 | 12.2 | 0.057 | 94.1 | 6.5 |

The results shown in Table 1 indicated that both filter process rates and bitumen recoveries are almost identical in two tests with and without baffles. Standard baffles caused significant increase in energy input without any benefits in bitumen extraction or filtration.

References in the specification to "one embodiment", "an embodiment", etc., indicate that the embodiment described may include a particular aspect, feature, structure, or characteristic, but not every embodiment necessarily includes that aspect, feature, structure, or characteristic. Moreover, such phrases may, but do not necessarily, refer to the same embodiment referred to in other portions of the specification. Further, when a particular aspect, feature, structure, or characteristic is described in connection with an embodiment, it is within the knowledge of one skilled in the art to affect or connect such module, aspect, feature, structure, or characteristic with other embodiments, whether or not explicitly described. In other words, any module, element or feature may be combined with any other element or feature in different embodiments, unless there is an obvious or inherent incompatibility, or it is specifically excluded.

It is further noted that the claims may be drafted to exclude any optional element. As such, this statement is intended to serve as antecedent basis for the use of exclusive terminology, such as "solely," "only," and the like, in connection with the recitation of claim elements or use of a "negative" limitation. The terms "preferably," "preferred," "prefer," "optionally," "may," and similar terms are used to indicate that an item, condition or step being referred to is an optional (not required) feature.

The singular forms "a," "an," and "the" include the plural reference unless the context clearly dictates otherwise. The term "and/or" means any one of the items, any combination of the items, or all of the items with which this term is associated. The phrase "one or more" is readily understood by one of skill in the art, particularly when read in context of its usage.

The term "about" can refer to a variation of ±5%, ±10%, ±20%, or ±25% of the value specified. For example, "about 50" percent can in some embodiments carry a variation from 45 to 55 percent. For integer ranges, the term "about" can include one or two integers greater than and/or less than a recited integer at each end of the range. Unless indicated otherwise herein, the term "about" is intended to include values and ranges proximate to the recited range that are equivalent in terms of the functionality of the composition, or the embodiment.

As will be understood by one skilled in the art, for any and all purposes, particularly in terms of providing a written description, all ranges recited herein also encompass any and all possible sub-ranges and combinations of sub-ranges thereof, as well as the individual values making up the range, particularly integer values. A recited range includes each specific value, integer, decimal, or identity within the range. Any listed range can be easily recognized as sufficiently describing and enabling the same range being broken down into at least equal halves, thirds, quarters, fifths, or tenths. As a non-limiting example, each range discussed herein can be readily broken down into a lower third, middle third and upper third, etc.

As will also be understood by one skilled in the art, all language such as "up to", "at least", "greater than", "less than", "more than", "or more", and the like, include the number recited and such terms refer to ranges that can be subsequently broken down into sub-ranges as discussed above. In the same manner, all ratios recited herein also include all sub-ratios falling within the broader ratio.

What is claimed is:

1. A process for flocculating or agglomerating oil sand solids during solvent extraction of bitumen from oil sand ore, comprising:

(a) treating the oil sand ore with at least one solvent to produce a slurry comprising an oil sand and a solvent;

(b) feeding the slurry into a mixing tank and adding a bridging liquid to the mixing tank to flocculate or agglomerate solids present in the slurry to produce an aggregated slurry; and (c) removing the aggregated slurry from the mixing tank and subjecting the aggregated slurry to a separation to separate liquid from solids;

wherein the mixing tank comprises a vertical baffle-free cylindrical vessel having at least one impeller mounted vertically therein, wherein the mixing tank has an upper structure located above the at least one impeller to inhibit rising of the slurry along internal walls of the mixing tank or to reduce a size of a central slurry vortex.

2. The process as claimed in claim 1, wherein the at least one solvent is a heavy solvent (HS).

3. The process as claimed in claim 1, wherein a heavy solvent (HS) and a light solvent (LS) is used to produce the slurry.

4. The process as claimed in claim 1, wherein the at least one solvent is a light solvent (LS).

5. The process as claimed in claim 1, wherein the oil sand ore is pre-crushed oil sand ore.

6. The process as claimed in claim 1, wherein the at least one impeller has a diameter of about 0.5 to 0.8 times that of the cylindrical vessel diameter.

7. The process as claimed in claim 1, wherein the at least one impeller comprises a plurality of blades or vanes.

8. The process as claimed in claim 7, wherein the blades are down-pumping blades or up-pumping blades or both.

9. The process as claimed in claim 1, wherein the at least one impeller comprises a pitched blade turbine (PBT) mixing impeller or a flat blade turbine mixing impeller.

10. The process as claimed in claim 9, wherein the PBT is a 45° PBT.

11. The process as claimed in claim 1, wherein the slurry is added to the mixing tank so that a height of the oil sand and solvent slurry is about 0.2 to 0.8 times the cylindrical vessel diameter.

12. The process as claimed in claim 1, wherein the at least one vertically mounted impeller is mounted at a height of about 0.01 to about 0.1 times the cylindrical vessel diameter from the bottom of the cylindrical vessel.

13. The process as claimed in claim 1, wherein a plurality of mixing tanks are used to produce the aggregated slurry.

14. The process as claimed in claim 13, wherein the plurality of mixing tanks comprises two mixing tanks that are used in parallel, and the two mixing tanks are connected through an opening.

15. The process as claimed in claim 14, wherein the opening is about 0.2 to about 1.0 of the mixing tanks diameter.

16. The process as claimed in claim 13, whereby four mixing tanks are used in two parallel trains and the four mixing tanks connected to one another through an opening.

17. The process as claimed in claim 16, wherein the opening is about 0.2 to about 1.0 of the mixing tanks diameter.

18. The process of either claim 14 or claim 16, whereby the directions of slurry motion are the same at each mixing tank connection.

19. The process of either claim 14 or claim 16, whereby the directions of motion are different at each mixing tank connection.

20. The process of claim 1, wherein the vertical baffle-free cylindrical vessel has a closed top having a lid, a closed bottom and vessel diameter; and the at least one impeller is a single impeller present in the vertical baffle-free cylindrical vessel.

21. The process of claim 20, wherein the impeller has a diameter of 0.5 to 0.8 times the vessel diameter of the vertical baffle-free cylindrical vessel.

22. The process of claim 21, wherein the impeller has a bottom clearance of 0.01 to 0.1 of the vessel diameter.

23. The process of claim 22, wherein the mixing tank further comprises a slurry discharge at the closed bottom of the mixing tank.

24. The process of claim 22, wherein the impeller comprises down-pumping pitched-bladed turbines (PBT).

25. The process of claim 22, wherein the impeller comprises up-pumping pitched-bladed turbines (PBT).

26. The process of claim 22, wherein the impeller is a flat blade turbine.

27. The process of claim 22, wherein the upper structure comprises at least one horizontal plate or tube positioned above the impeller and being configured to provide heat to the solvent slurry.

28. The process of claim 20, wherein the upper structure comprises at least one horizontal plate or tube positioned above the impeller and having a partially circumferential shape, the at least one horizontal plate or tube being configured to inhibit rising of the slurry along the internal walls of the vertical baffle-free cylindrical vessel and reduce a size of a central slurry vortex.

29. The process of claim 20, wherein the upper structure comprises at least one horizontal plate or tube positioned above the impeller and having a completely circumferential shape, the at least one horizontal plate or tube being configured to inhibit rising of the slurry along the internal walls of the vertical baffle-free cylindrical vessel and reduce a size of a central slurry vortex.

30. The process of claim 1, wherein the at least one impeller is configured and operated to provide vertical movement of the slurry along the internal walls of the mixing tank to generate mixing action and shear to flocculate or agglomerate the solids and provide tangential velocity in the mixing tank that inhibits solids buildup, while reducing mixing energy compared to a corresponding baffled mixing tank.

* * * * *